US011435144B2

(12) United States Patent
Liu et al.

(10) Patent No.: US 11,435,144 B2
(45) Date of Patent: Sep. 6, 2022

(54) HEAT DISSIPATION DEVICE

(71) Applicant: ASIA VITAL COMPONENTS (CHINA) CO., LTD., Shenzhen (CN)

(72) Inventors: Han-Min Liu, Shenzhen (CN); Jian Zhang, Shenzhen (CN); Xing-Xing Lyu, Shenzhen (CN)

(73) Assignee: Asia Vital Components (China) Co., Ltd., Shenzhen (CN)

( * ) Notice: Subject to any disclaimer, the term of this patent is extended or adjusted under 35 U.S.C. 154(b) by 93 days.

(21) Appl. No.: 16/531,128

(22) Filed: Aug. 5, 2019

(65) Prior Publication Data

US 2021/0041181 A1 Feb. 11, 2021

(51) Int. Cl.
*F28D 15/04* (2006.01)

(52) U.S. Cl.
CPC ..... *F28D 15/04* (2013.01)

(58) Field of Classification Search
CPC ..... F28D 15/00; F28D 15/02; F28D 15/0233; F28D 15/025; F28D 15/0275; F28D 15/04; F28D 15/046; F28D 15/06; F28D 23/00; F28D 2015/0216; F28F 23/00
See application file for complete search history.

(56) References Cited

U.S. PATENT DOCUMENTS 4,145,708 A * 3/1979 Ferro ..... F28D 15/0266 257/715
5,198,889 A * 3/1993 Hisano ..... F28D 15/0266 257/678
5,216,580 A * 6/1993 Davidson ..... F28D 15/0266 361/700
5,848,637 A * 12/1998 Lee ..... A23L 3/365 165/104.21
6,237,223 B1 * 5/2001 McCullough ..... B23P 15/26 257/E23.089
6,374,905 B1 * 4/2002 Tantoush ..... H01L 23/367 165/104.33
6,490,160 B2 * 12/2002 Dibene, II ..... G06F 1/18 165/104.26

(Continued)

FOREIGN PATENT DOCUMENTS

CN 2784853 Y 5/2006
CN 1869574 A 11/2006

(Continued)

OTHER PUBLICATIONS

Search Report dated Jan. 9, 2020 issued by Taiwan Intellectual Property Office for counterpart application No. 108125663.

*Primary Examiner* — Jianying C Atkisson
*Assistant Examiner* — Jose O Class-Quinones
(74) *Attorney, Agent, or Firm* — Bradley J. Thorson; DeWitt LLP

(57) ABSTRACT

A heat dissipation device includes a base seat having a first chamber. The first chamber has multiple partitioning sections to partition the first chamber into multiple rooms without communicating with each other. A first working fluid is disposed in the rooms. Multiple two-phase fluid radiating fins are disposed on upper side of the base seat. Each of the two-phase fluid radiating fins is formed with an internal second chamber in communication with the rooms or not in communication with the rooms. The heat dissipation device can achieve better heat dissipation effect.

20 Claims, 7 Drawing Sheets

(56) References Cited

U.S. PATENT DOCUMENTS 6,745,825 B1 * 6/2004 Nakamura ..... F28D 15/0233 165/104.26
6,899,165 B1 * 5/2005 Wu ..... F28D 15/0233 165/104.21
7,369,410 B2 * 5/2008 Chen ..... F28D 15/0233 165/104.21
7,420,810 B2 * 9/2008 Reis ..... C09K 5/041 165/104.26
7,965,511 B2 * 6/2011 Refai-Ahmed ..... H01L 23/427 361/700
8,235,096 B1 * 8/2012 Mahefkey ..... F28D 15/046 165/104.26
8,479,805 B2 * 7/2013 Chang ..... F28F 3/12 165/80.3
9,436,235 B2 * 9/2016 Damaraju ..... H01L 23/427
9,506,699 B2 * 11/2016 Wu ..... F28D 15/046
10,043,732 B1 * 8/2018 Al Omari ..... H01L 23/3736
10,297,524 B2 * 5/2019 Watanabe ..... H01L 21/4882
10,663,231 B2 * 5/2020 Tan ..... F28D 15/0275
2002/0033247 A1 * 3/2002 Neuschutz ..... F28D 20/02 165/10
2002/0118511 A1 * 8/2002 Dujari ..... F28D 15/0233 361/703
2004/0182086 A1 * 9/2004 Chiang ..... F25B 23/006 62/3.1
2004/0190253 A1 * 9/2004 Prasher ..... G06F 1/203 361/699
2005/0028965 A1 * 2/2005 Chen ..... F28D 15/0275 165/104.21
2005/0155746 A1 * 7/2005 Chen ..... F28D 15/0233 165/104.33
2005/0178532 A1 * 8/2005 Meng-Cheng ..... F28D 15/0233 165/104.33
2006/0005951 A1 * 1/2006 Yeh ..... F28F 13/18 165/104.26
2006/0137859 A1 * 6/2006 Lin ..... G06F 1/203 165/104.26
2006/0162904 A1 * 7/2006 Bhatti ..... H01L 23/427 165/104.14
2006/0237167 A1 * 10/2006 Lee ..... F28D 15/0233 165/104.26
2007/0012429 A1 * 1/2007 Siu ..... F28F 21/062 165/104.33
2007/0022603 A1 * 2/2007 Chuang ..... F28D 15/0233 29/890.032
2007/0025085 A1 * 2/2007 Chang ..... F28D 15/0233 361/704
2007/0068656 A1 * 3/2007 Lee ..... H01L 23/427 165/104.26
2007/0227703 A1 * 10/2007 Bhatti ..... F28D 15/02 165/104.26
2007/0246193 A1 10/2007 Bhatti et al.
2007/0272399 A1 * 11/2007 Nitta ..... F28D 15/046 165/185
2008/0144319 A1 * 6/2008 Chang ..... F21V 29/763 362/294
2008/0175008 A1 * 7/2008 Hu ..... F21V 29/51 362/373
2009/0166014 A1 * 7/2009 Chang ..... F28D 15/02 165/133
2010/0002392 A1 * 1/2010 Liu ..... H01L 23/427 361/699
2010/0326644 A1 * 12/2010 Hung ..... F28D 15/0283 165/185
2011/0146955 A1 * 6/2011 Chen ..... B22F 7/08 165/104.26
2013/0039012 A1 * 2/2013 Shih ..... H01L 23/473 361/700
2014/0131011 A1 5/2014 Kim
2015/0000866 A1 * 1/2015 Lin ..... F28D 15/0233 165/67
2015/0060020 A1 * 3/2015 Yang ..... H01L 23/427 165/104.26
2015/0219401 A1 * 8/2015 Zhang ..... F28D 15/0283 165/104.26
2015/0285562 A1 * 10/2015 Huang ..... B23P 15/26 165/104.21
2016/0309619 A1 * 10/2016 Tsai ..... F28F 3/12
2017/0003083 A1 * 1/2017 Manninen ..... F28D 1/0226
2017/0059254 A1 * 3/2017 Zhang ..... F28D 15/0233
2017/0115071 A1 * 4/2017 Lin ..... H01L 23/473
2017/0268828 A1 * 9/2017 Lin ..... F28D 15/02
2017/0312871 A1 * 11/2017 Lin ..... F28D 15/0283
2017/0314873 A1 * 11/2017 Lin ..... F28D 15/0233
2017/0347489 A1 * 11/2017 Lan ..... F28D 15/0233
2018/0361460 A1 * 12/2018 Chiang ..... F28F 21/086

FOREIGN PATENT DOCUMENTS

CN 108271332 A 7/2018
TW M309091 4/2007
TW I596312 8/2017
TW M584591 10/2019

* cited by examiner

HEAT DISSIPATION DEVICE

BACKGROUND OF THE INVENTION

1. Field of the Invention

The present invention relates generally to a heat dissipation device, and more particularly to a heat dissipation device including a base seat having a first chamber. Multiple two-phase fluid radiating fins are disposed on upper side of the base seat. Each of the two-phase fluid radiating fins is formed with an internal second chamber. A first working fluid is disposed in the first chamber and a second working fluid is disposed in the second chamber to achieve better heat dissipation effect.

2. Description of the Related Art

Along with the advance of sciences and technologies, the operation function and efficiency of various current electronic devices such as mobile devices, personal computers, servers, communication chasses, base stations and other systems or devices have become more and more powerful. The internal heat generation components (such as, but not limited to, chips and various power components) of these devices will all generate high heat in operation. Therefore, it is necessary to dissipate the heat of the heat generation components so as to avoid overheating of these heat generation components, which will lead to failure of these heat generation components. In general, a heat dissipation device is mounted on the heat generation components to prolong the lifetime thereof.

In the conventional heat dissipation device, solid radiating fins are disposed on the vapor chamber. The solid radiating fins serve to enlarge the heat dissipation area so as to enhance the heat dissipation effect. Alternatively, a fan can be further disposed to create greater air volume for dissipating the heat. However, the current mobile devices, personal computers, servers, communication chasses, base stations and other systems or devices have a narrow internal space so that it is hard to dispose a fan therein. Moreover, the heat conductivity of the material of the solid radiating fins itself will affect the heat dissipation effect. Therefore, the conventional heat dissipation device with the solid radiating fins disposed on the vapor chamber can hardly meet the industrial technical requirement in the future.

It is therefore tried by the applicant to provide a heat dissipation device, which can achieve better heat dissipation effect.

SUMMARY OF THE INVENTION

It is therefore a primary object of the present invention to provide a heat dissipation device, which can be used in a narrow space and an environment with low air volume. The heat dissipation device can achieve better heat dissipation effect without being affected by the heat conductivity of the material itself.

To achieve the above and other objects, the heat dissipation device of the present invention includes a base seat having a first chamber. The first chamber has multiple partitioning sections to partition the first chamber into multiple rooms without communicating with each other. A first working fluid is disposed in the rooms. Multiple two-phase fluid radiating fins are disposed on upper side of the base seat. Each of the two-phase fluid radiating fins is formed with an internal second chamber in communication with the rooms or not in communication with the rooms.

Still to achieve the above and other objects, the heat dissipation device of the present invention includes a base seat having a first chamber. The first chamber is one single independent chamber. A first working fluid is disposed in the first chamber. Multiple two-phase fluid radiating fins are disposed on upper side of the base seat. Each of the two-phase fluid radiating fins is formed with an internal second chamber not in communication with the independent chamber. A second working fluid is disposed in each of the second chambers.

In comparison with the conventional heat dissipation device with the solid radiating fins, the heat dissipation device of the present invention can be used in a narrow space and an environment with low air volume without being affected by the heat conductivity of the material itself so that the heat dissipation device of the present invention can achieve better heat dissipation effect.

BRIEF DESCRIPTION OF THE DRAWINGS

The structure and the technical means adopted by the present invention to achieve the above and other objects can be best understood by referring to the following detailed description of the preferred embodiments and the accompanying drawings, wherein.

DETAILED DESCRIPTION OF THE PREFERRED EMBODIMENTS

Figure 1:
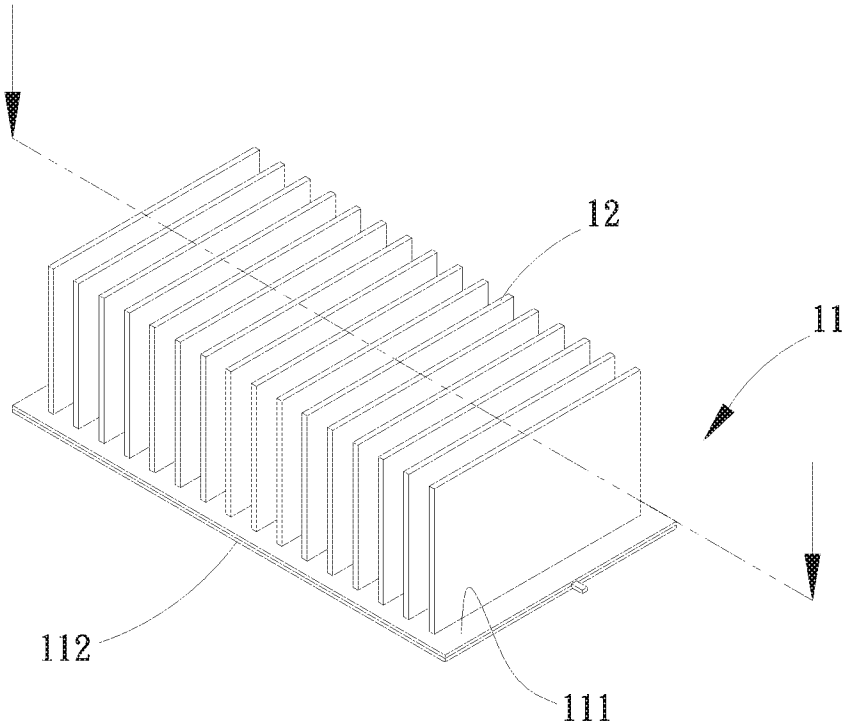
FIG. 1 is a perspective assembled view of a first embodiment of the heat dissipation device of the present invention.
Figure 2:
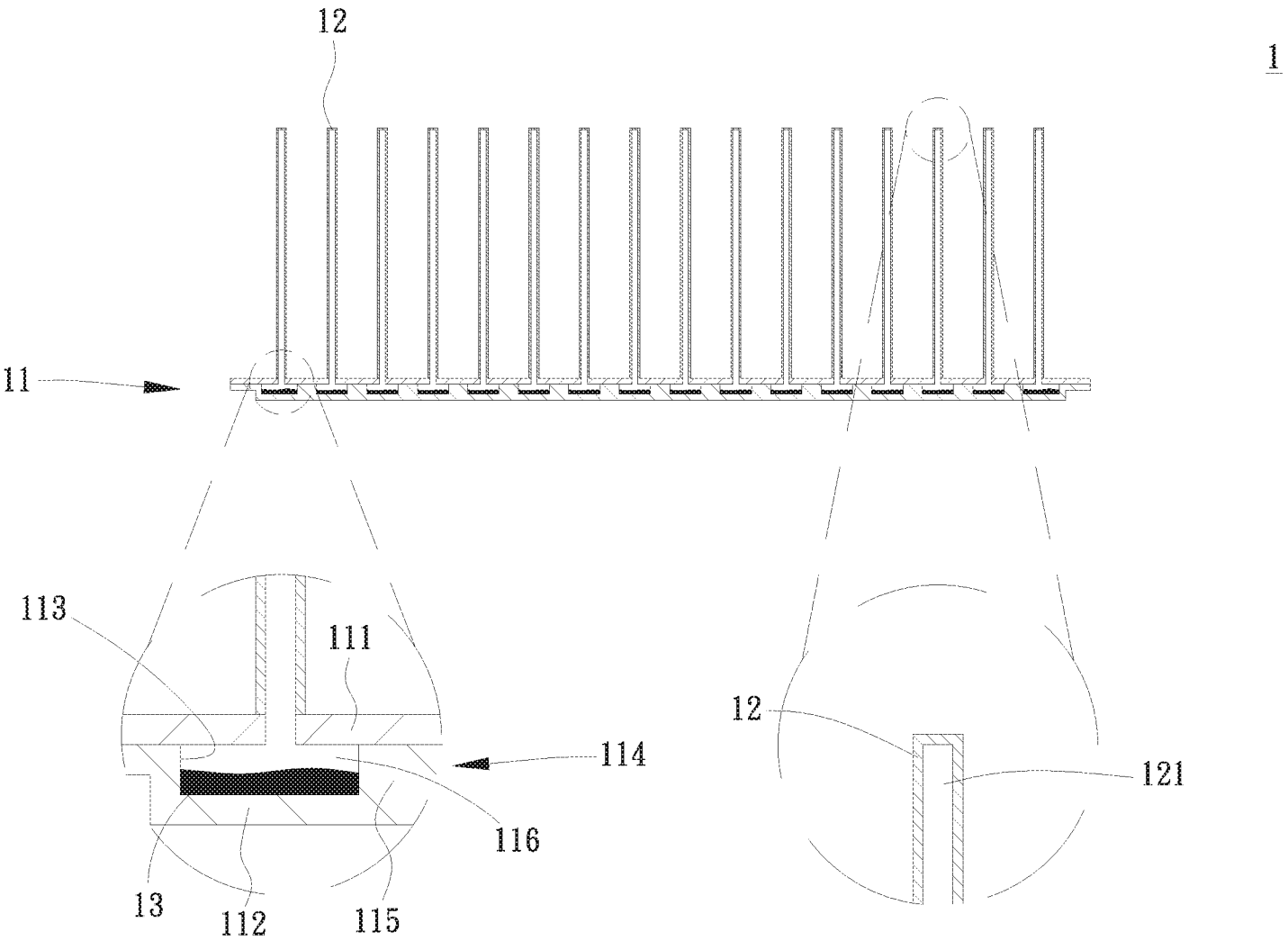
FIG. 2 is a sectional assembled view of the first embodiment of the heat dissipation device of the present invention.

Please refer to FIGS. 1 and 2. FIG. 1 is a perspective assembled view of a first embodiment of the heat dissipation device of the present invention. FIG. 2 is a sectional assembled view of the first embodiment of the heat dissipation device of the present invention. According to the first embodiment, the heat dissipation device 1 of the present invention is applied to a heat source of an electronic device for dissipating the heat of the heat source. In this embodiment, the heat dissipation device 1 is in contact and attachment with one or more heat generation components (not shown) disposed on a circuit board (such as a motherboard) of an electronic device so as to dissipate the heat of the heat generation components. The heat generation components can be, but not limited to, central processing unit and graphics processing unit. In practice, the heat generation components can be alternatively such as a Northbridge chip, a Southbridge chip, a transistor, a power component or any other electronic component on the circuit board that needs heat dissipation.

The heat dissipation device 1 includes a base seat 11, multiple two-phase fluid radiating fins 12 and a first working fluid 13. The base seat 11 has an upper plate 111, a lower plate 112, a recess 113 and a first chamber 114.

The upper plate 11 and the lower plate 112 are correspondingly mated with each other. The two-phase fluid radiating fins 12 are disposed on the upper plate 111 of the base seat 11. The lower side of the lower plate 112 is attached to the heat generation components to absorb heat. In this embodiment, the recess 113 is formed on the lower plate 112. In a modified embodiment, the recess 113 can be alternatively formed on the upper plate 111. The upper and lower plates 111, 112 and the recess 113 together define the first chamber 114. The first chamber 114 has multiple partitioning sections 115 to partition the first chamber 114 into multiple rooms 116. In this embodiment, the partitioning sections 115 are formed on the lower plate 112. In a modified embodiment, the partitioning sections 115 can be alternatively formed on the upper plate 111. The rooms 116 are not in communication with each other. The first working fluid 13 is disposed in the rooms 116. The first working fluid 13 is a vapor-phase fluid or a vapor-liquid two-phase fluid.

Each of the two-phase fluid radiating fins 12 is formed with an internal second chamber 121 in communication with the room 116. The two-phase fluid radiating fins 12 are formed by means of mechanical processing selected from a group consisting of aluminum extrusion, punching, die casting, drawing, injection and roll bonding. The base seat 11 and the two-phase fluid radiating fins 12 are made of a material selected from a group consisting of gold, silver, copper, copper alloy, aluminum, aluminum alloy, commercial pure titanium, titanium alloy and stainless steel. In this embodiment, the two-phase fluid radiating fins 12 are connected with the upper plate 111 in a manner selected from, but not limited to, a group consisting of welding, insertion, engagement, adhesion and latching. In a modified embodiment, the base seat 11 and the two-phase fluid radiating fins 12 are integrally formed by means of 3D printing.

According to the design of the present invention, the lower side of the base seat 11 absorbs the heat. Thereafter, the first working fluid 13 absorbs the heat of the base seat 11 in the rooms 116. The first working fluid 13 quickly transfers the heat in horizontal direction to spread the heat. At the same time, the first working fluid 13 enters the second chambers 121 to quickly transfer the heat in vertical direction. The two-phase fluid radiating fins 12 absorb the heat of the first working fluid 13 to radiate and dissipate the heat to the ambient environment. Therefore, in a narrow space and a low air volume environment, the heat dissipation device 1 of the present invention will not be affected by the heat conductivity of the material itself and is able to achieve better heat dissipation effect.

Figure 3:
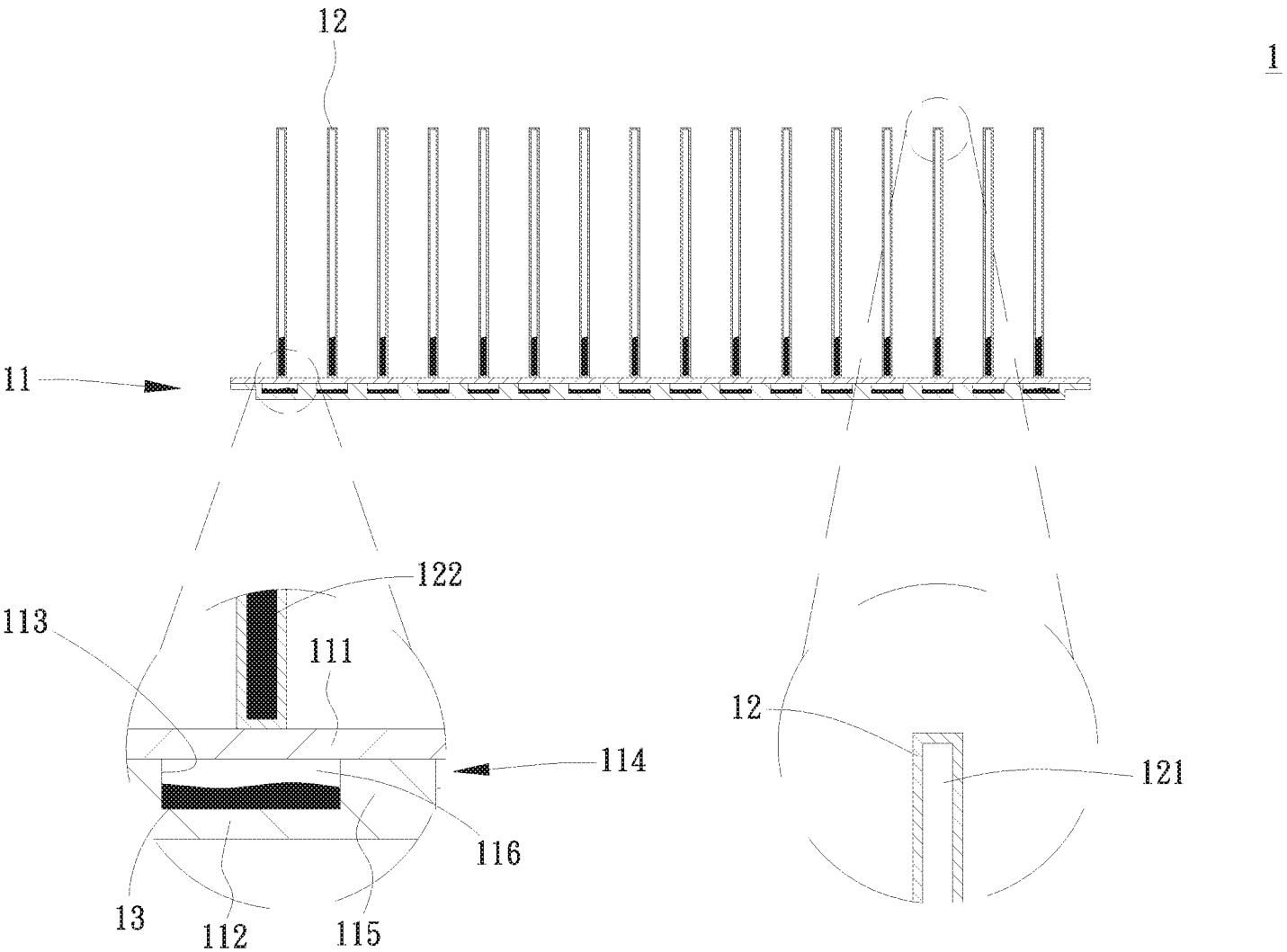
FIG. 3 is a sectional assembled view of a second embodiment of the heat dissipation device of the present invention.

Please now refer to FIG. 3, which is a sectional assembled view of a second embodiment of the heat dissipation device of the present invention. Also referring to FIGS. 1 and 2, the second embodiment is partially identical to the first embodiment in structure and function and thus will not be redundantly described hereinafter. The second embodiment is different from the first embodiment in that the rooms 116 are not in communication with the second chambers 121. A second working fluid 122 is disposed in the second chambers 121. The second working fluid 122 is a vapor-phase fluid or a vapor-liquid two-phase fluid.

The lower side of the base seat 11 absorbs the heat. Thereafter, the first working fluid 13 absorbs the heat of the base seat 11 in the rooms 116. At the same time, the lower sides of the two-phase fluid radiating fins 12 absorb the heat of the base seat 11. The second working fluid 122 quickly transfers the heat in vertical direction. The two-phase fluid radiating fins 12 absorb the heat of the second working fluid 122 to radiate and dissipate the heat to the ambient environment. The rooms 116 are not in communication with the second chambers 121. Therefore, after the first working fluid 13 quickly transfers the heat in horizontal direction to spread the heat, the first working fluid 13 is condensed to flow from the upper plate 111 back to the lower plate 112 by a shorter distance. Therefore, the first working fluid 13 at lower temperature can be quickly provided for the heat generation components to absorb the heat.

Figure 4:
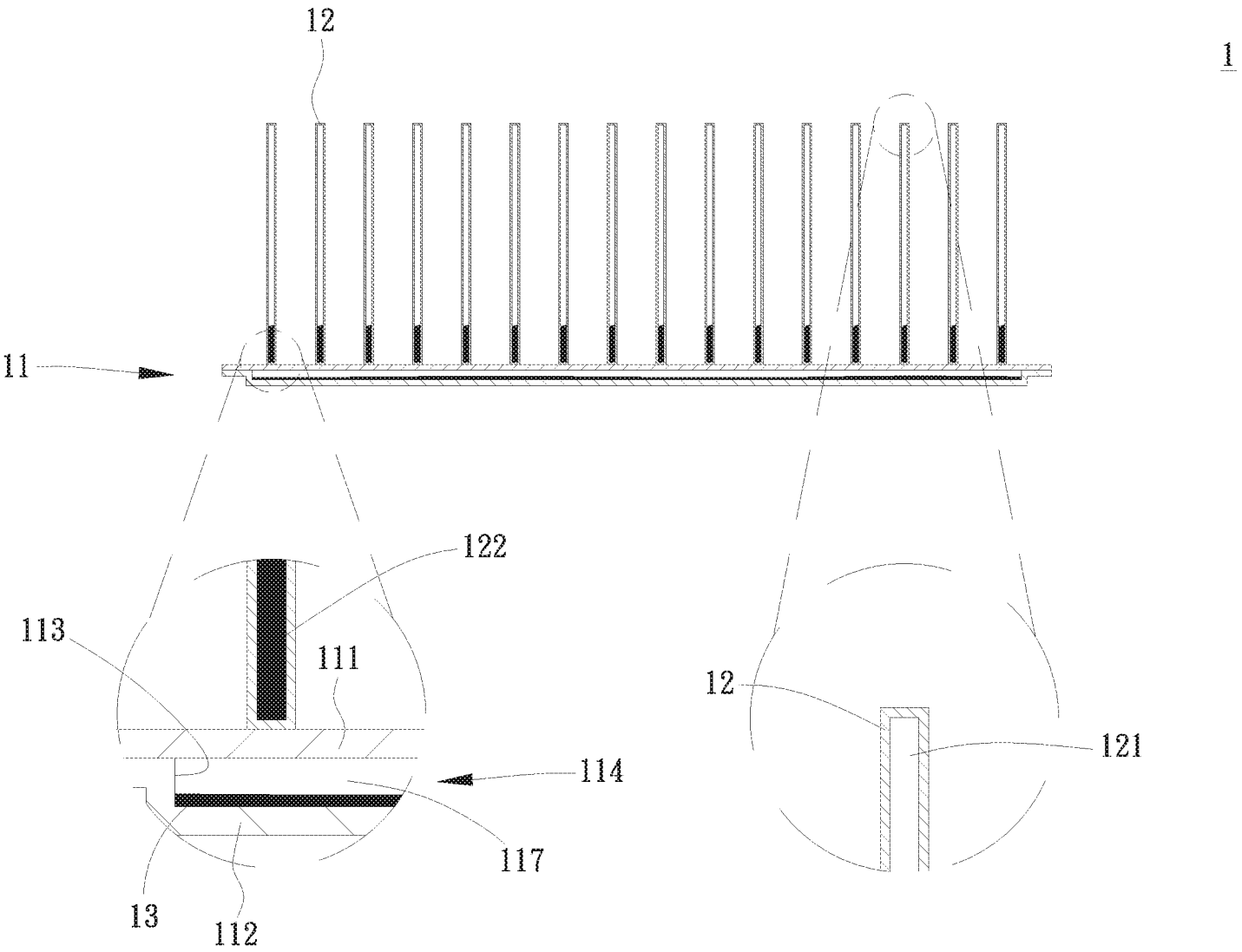
FIG. 4 is a sectional assembled view of a third embodiment of the heat dissipation device of the present invention.

Please now refer to FIG. 4, which is a sectional assembled view of a third embodiment of the heat dissipation device of the present invention. Also referring to FIG. 3, the third embodiment is partially identical to the second embodiment in structure and function and thus will not be redundantly described hereinafter. The third embodiment is different from the second embodiment in that the first chamber 114 is one single independent chamber 117 without any partitioning section 116. The independent chamber 117 in not in communication with the second chambers 121.

The first working fluid 13 in the independent chamber 117 can quickly transfer the heat in horizontal direction to the surrounding so as to spread the heat.

Figure 5:
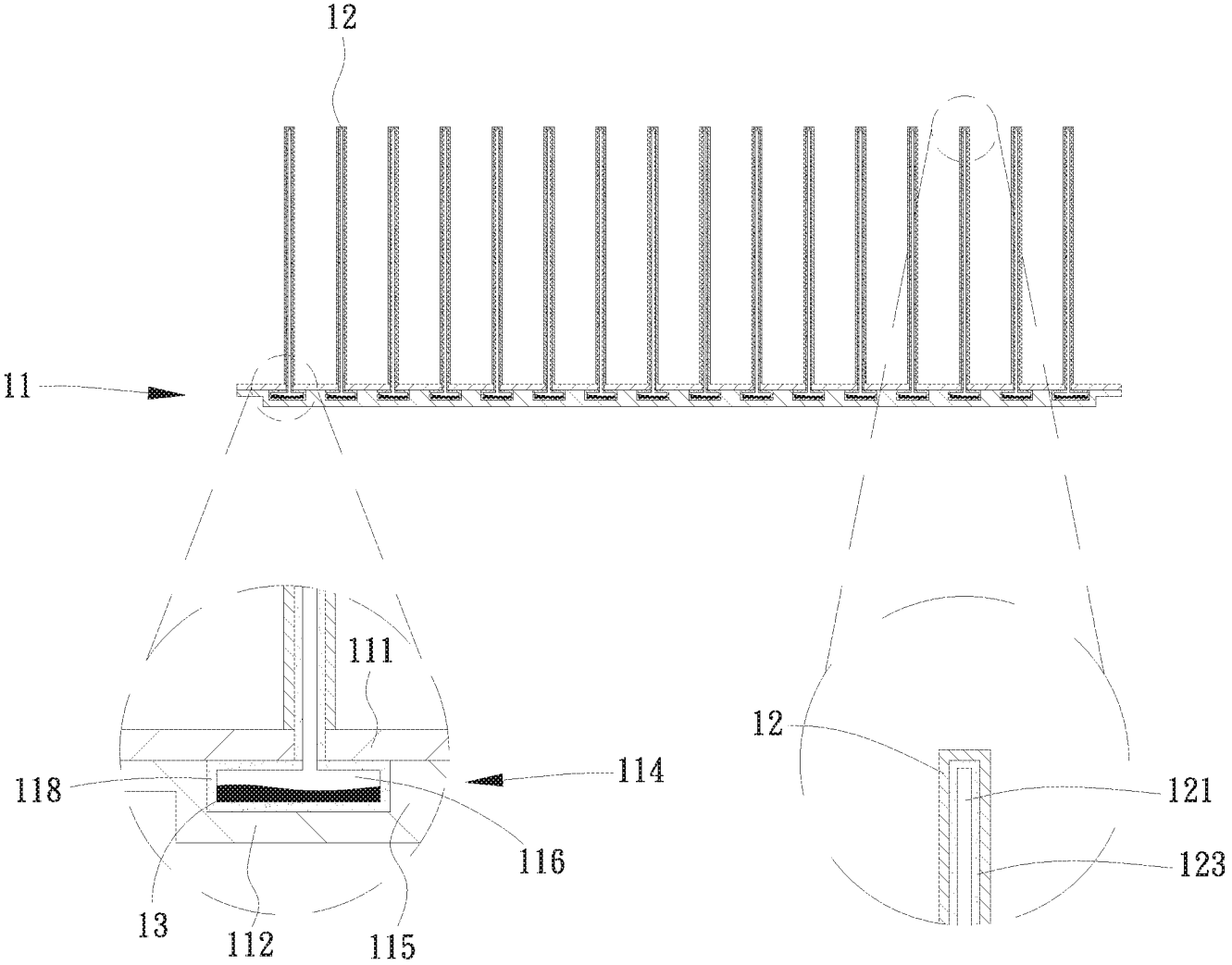
FIG. 5 is a sectional assembled view of a fourth embodiment of the heat dissipation device of the present invention.
Figure 6:
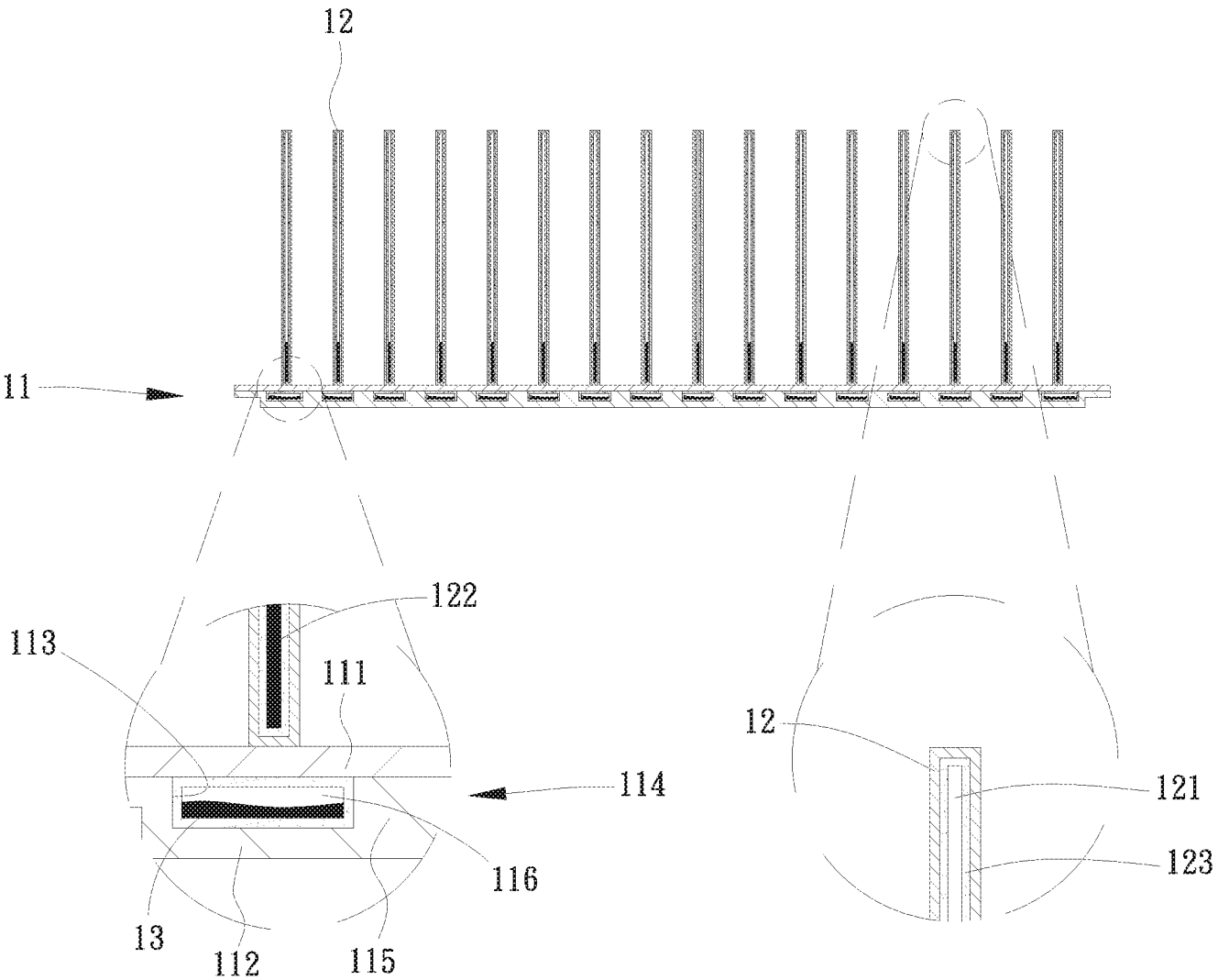
FIG. 6 is a sectional assembled view of a fourth embodiment of the heat dissipation device of the present invention.
Figure 7:
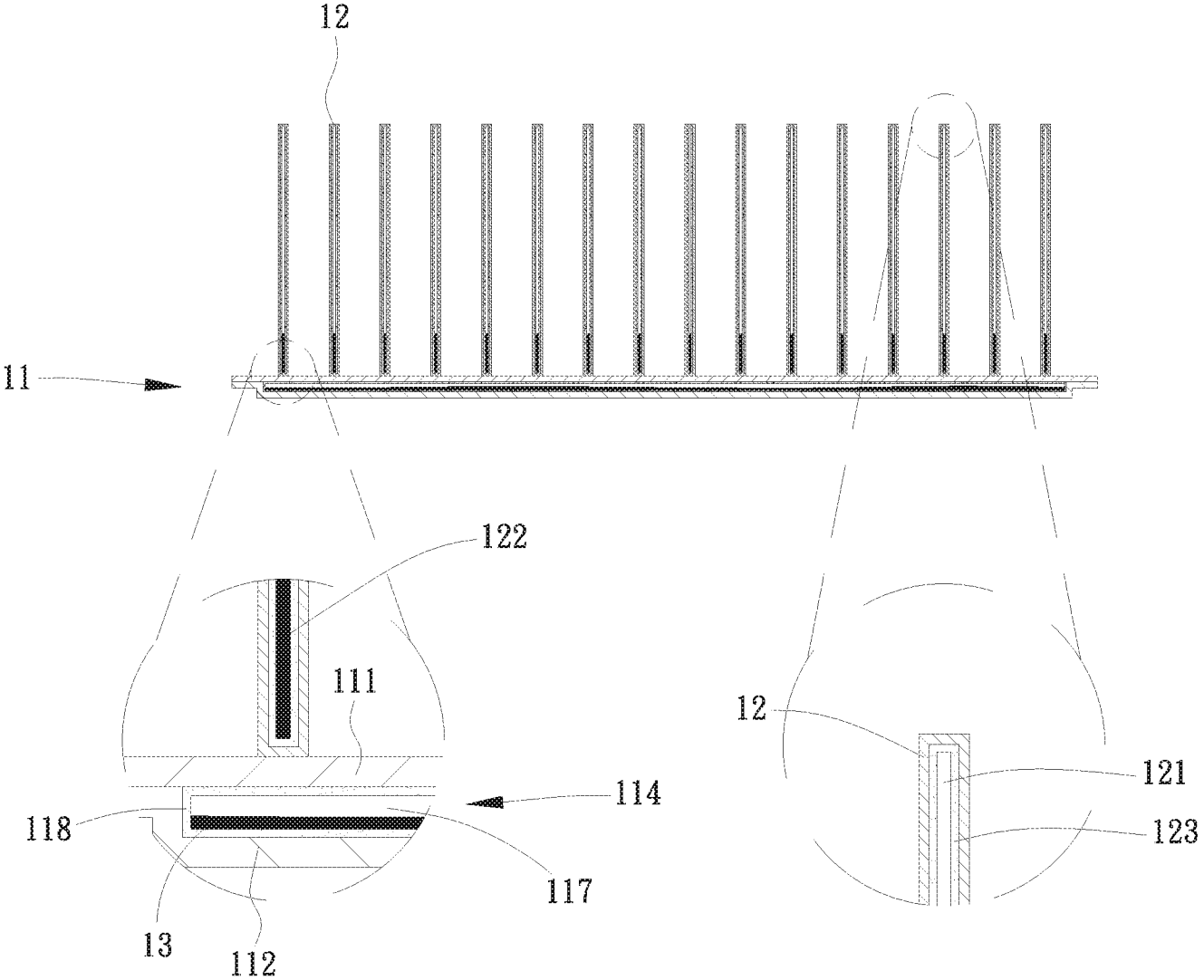
FIG. 7 is a sectional assembled view of a fourth embodiment of the heat dissipation device of the present invention.

Please now refer to FIGS. 5 to 7. FIG. 5 is a sectional assembled view of a fourth embodiment of the heat dissipation device of the present invention. FIG. 6 is a sectional assembled view of a fourth embodiment of the heat dissipation device of the present invention. FIG. 7 is a sectional assembled view of a fourth embodiment of the heat dissipation device of the present invention. Also referring to FIGS. 1 to 4, the fourth embodiment is partially identical to the first, second and third embodiments in structure and function and thus will not be redundantly described hereinafter. The fourth embodiment is different from the first, second and third embodiments in that a first capillary structure 118 is disposed in the first chamber 114 and a second capillary structure 123 is disposed in each of the second chambers 121. The first and second capillary structures 118, 123 are selected from a group consisting of mesh body, fiber body, porous structure body, channeled body and any combination thereof.

In the case that the rooms 116 are in communication with the second chambers 121, the first and second capillary structures 118, 123 are capillarily connected with each other (as shown in FIG. 5). By means of the first and second capillary structures 118, 123, after condensed in the second chambers 121, the first working fluid 13 can quickly flow back to the rooms 116. In the case that the rooms 116 (as shown in FIG. 6) or the one single independent chamber 117 (as shown in FIG. 7) is not in communication with the second chambers 121, after condensed on the upper plate 111, the first capillary structure 118 can make the first working fluid 13 quickly flow back to the lower plate 112. Also, after condensed in the upper side of the second chamber 121, the second capillary structure 123 can make the second working fluid 122 quickly flow back to the lower side of the second chamber 121.

The term "capillarily connected" mentioned above means the porous structure of the first capillary structure 118 communicates with the porous structure of the second capillary structure 123, whereby the capillary attraction can be transferred or extended from the capillary structure 118 to the second capillary structure 123.

In a modified embodiment, the second capillary structure 123 is omitted and the first and second working fluids 13, 122 flow back under gravity.

In still a modified embodiment, a coating (not shown) is disposed on the inner walls of the first and second chambers 114, 121 or disposed on the first and second capillary structures 118, 123 or disposed on both the inner walls of the first and second chambers 114, 121 and the first and second capillary structures 118, 123 so as to enhance the hydrophilicity of the inner walls of the first and second chambers 114, 121 and the first and second capillary structures 118, 123. Accordingly, the first and second working fluids 13, 122 can more quickly and collectively flow back.

The present invention has been described with the above embodiments thereof and it is understood that many changes and modifications in such as the form or layout pattern or practicing step of the above embodiments can be carried out without departing from the scope and the spirit of the invention that is intended to be limited only by the appended claims.

What is claimed is:

1. A heat dissipation device comprising a base seat having an upper plate, a lower plate, a recess and a first chamber, the upper plate and the lower plate being correspondingly mated with each other, the upper and lower plates and the recess together defining the first chamber, the first chamber having multiple partitioning sections to partition the first chamber into multiple rooms that are not in fluid communication with each other, a first working fluid being disposed in the rooms, at least three two-phase fluid radiating fins being adjacently disposed on an upper side of the upper plate of the base seat and extending perpendicularly from the upper side, the at least three two-phase fluid radiating fins being spaced apart by an equal interval; each of the two-phase fluid radiating fins being formed with an internal second chamber that is in two-phase fluid communication with a corresponding one of the rooms.

2. The heat dissipation device as claimed in claim 1, wherein the recess being formed on the upper plate or the lower plate, the partitioning sections being formed on the upper plate or the lower plate.

3. The heat dissipation device as claimed in claim 1, wherein the base seat and the two-phase fluid radiating fins are integrally formed.

4. The heat dissipation device as claimed in claim 1, wherein a first capillary structure is disposed in the first chamber, the first capillary structure being selected from a group consisting of mesh body, fiber body, porous structure body, channeled body and any combination thereof.

5. The heat dissipation device as claimed in claim 4, wherein a second capillary structure is disposed in each of the second chambers, the second capillary structure being selected from a group consisting of mesh body, fiber body, porous structure body, channeled body and any combination thereof.

6. The heat dissipation device as claimed in claim 5, further comprising a coating, the coating being correspondingly disposed on inner walls of the first and second chambers or disposed on the first and second capillary structures or disposed on both the inner walls of the first and second chambers and the first and second capillary structures.

7. The heat dissipation device as claimed in claim 1, wherein the first working fluid is a vapor-phase fluid or a vapor-liquid two-phase fluid.

8. The heat dissipation device as claimed in claim 1, wherein the two-phase fluid radiating fins are formed by means of mechanical processing selected from a group consisting of aluminum extrusion, punching, die casting, drawing, injection and roll bonding.

9. The heat dissipation device as claimed in claim 1, wherein the base seat and the two-phase fluid radiating fins are made of a material selected from a group consisting of gold, silver, copper, copper alloy, aluminum, aluminum alloy, commercial pure titanium, titanium alloy and stainless steel.

10. A heat dissipation device comprising a base seat having an upper plate, a lower plate, a recess and a first chamber, the upper plate and the lower plate being correspondingly mated with each other, the upper and lower plates and the recess together defining the first chamber, the first chamber having multiple partitioning sections to partition the first chamber into multiple rooms that are not in fluid communication with each other, a first working fluid being disposed in the rooms, at least three two-phase fluid radiating fins being adjacently disposed on an upper side of the upper plate of the base seat and extending perpendicularly from the upper side, the at least three two-phase fluid radiating fins being spaced apart by an equal interval; each of the two-phase fluid radiating fins being formed with one single independent internal second chamber; wherein each of the rooms corresponds to a separate one of the second chambers, but is not in fluid communication with the corresponding second chamber, and a second working fluid is disposed in the second chambers.

11. The heat dissipation device as claimed in claim 10, wherein the second working fluid is a vapor-phase fluid or a vapor-liquid two-phase fluid.

12. A heat dissipation device comprising a base seat having an upper plate, a lower plate, a recess and a first chamber, the upper plate and the lower plate being correspondingly mated with each other, the upper and lower plates and the recess together defining the first chamber, the first chamber being one single independent chamber, a first working fluid being disposed in the first chamber, multiple at least three two-phase fluid radiating fins being adjacently disposed on an upper side of the upper plate of the base seat and extending perpendicularly from the upper side, the at least three two-phase fluid radiating fins being spaced apart by an equal interval; each of the two-phase fluid radiating fins being formed with one single independent internal second chamber not in fluid communication with the independent first chamber, a second working fluid being disposed in each of the second chambers.

13. The heat dissipation device as claimed in claim 12, wherein the recess being formed on the upper plate or the lower plate.

14. The heat dissipation device as claimed in claim 12, wherein the base seat and the two-phase fluid radiating fins are integrally formed.

15. The heat dissipation device as claimed in claim 12, wherein a first capillary structure is disposed in the first chamber, the first capillary structure being selected from a group consisting of mesh body, fiber body, porous structure body, channeled body and any combination thereof.

16. The heat dissipation device as claimed in claim 15, wherein a second capillary structure is disposed in each of the second chambers, the second capillary structure being selected from a group consisting of mesh body, fiber body, porous structure body, channeled body and any combination thereof.

17. The heat dissipation device as claimed in claim 16, further comprising a coating, the coating being correspondingly disposed on inner walls of the first and second chambers or disposed on the first and second capillary structures or disposed on both the inner walls of the first and second chambers and the first and second capillary structures.

18. The heat dissipation device as claimed in claim 12, wherein the first working fluid is a vapor-phase fluid or a vapor-liquid two-phase fluid.

19. The heat dissipation device as claimed in claim 12, wherein the two-phase fluid radiating fins are formed by means of mechanical processing selected from a group consisting of aluminum extrusion, punching, die casting, drawing, injection and roll bonding.

20. The heat dissipation device as claimed in claim 12, wherein the base seat and the two-phase fluid radiating fins are made of a material selected from a group consisting of gold, silver, copper, copper alloy, aluminum, aluminum alloy, commercial pure titanium, titanium alloy and stainless steel.

* * * * *